US007794212B2

(12) United States Patent
Hugelman

(10) Patent No.: US 7,794,212 B2
(45) Date of Patent: Sep. 14, 2010

(54) MULTI-PISTON PUMP/COMPRESSOR

(76) Inventor: Rodney D. Hugelman, 2830 Spring Heather Pl., Oviedo, FL (US) 32766

( * ) Notice: Subject to any disclaimer, the term of this patent is extended or adjusted under 35 U.S.C. 154(b) by 1058 days.

(21) Appl. No.: 11/176,168

(22) Filed: Jul. 7, 2005

(65) Prior Publication Data

US 2006/0008362 A1 Jan. 12, 2006

Related U.S. Application Data

(60) Provisional application No. 60/586,583, filed on Jul. 10, 2004.

(51) Int. Cl.
*F04B 1/12* (2006.01)

(52) U.S. Cl. ..... 417/269; 417/560; 91/504; 91/505; 91/506; 92/12.2; 92/13; 92/57; 74/839

(58) Field of Classification Search ..... 417/269, 417/457, 460, 560; 91/505, 506, 6.5, 483, 91/499, 503, 504; 92/54, 55, 56, 57, 12.2, 92/13; 74/839
See application file for complete search history.

(56) References Cited

U.S. PATENT DOCUMENTS 3,139,037 A * 6/1964 Budzich ..... 91/483
3,208,395 A * 9/1965 Budzich ..... 91/489
4,455,920 A * 6/1984 Shaw et al. ..... 92/12.2
5,724,879 A * 3/1998 Hugelman ..... 92/12.2
5,979,294 A * 11/1999 Hugelman ..... 92/12.2
6,629,488 B2 * 10/2003 Hugelman ..... 92/12.2

* cited by examiner

*Primary Examiner*—Devon C Kramer
*Assistant Examiner*—Leonard J Weinstein
(74) *Attorney, Agent, or Firm*—Knechtel, Demeur & Samlan

(57) ABSTRACT

A pump/compressor that utilizes a wedge at a fixed angle to operate the pump's pistons at a fixed stroke. Alternatively the wedge can be moved axially to increase or decrease the clearance volume. Variable fluid flow at any clearance volume is achieved by rotating the wedge with respect to the port plate thereby changing the timing of the pistons with respect to the fixed port plate which changes the timing of the intake and output cycles. This results in a portion of the intake charge being breathed back into the intake port and a portion of the output charge being breathed back from the outlet port. This causes the pistons to not take in a full charge from the inlet port and to not pump out a full charge into the outlet port. Thus, fluid flow is varied. The design results in a smaller pump as the wedge is supported by the pump housing rather than a mechanical linkage required of prior adjustable angle swashplate designs.

19 Claims, 7 Drawing Sheets

WhiteMoss Fixed Stroke Variable Flow Rate Pump

MULTI-PISTON PUMP/COMPRESSOR

CROSS-REFERENCE TO RELATED APPLICATION

This patent application is a non-provisional application claiming priority from U.S. Provisional Application Ser. No. 60/586,583, entitled "Multi-Piston Pump/Compressor" filed on Jul. 10, 2004.

FIELD OF THE INVENTION

This invention relates to a multi-piston axial machine that operates as a pump or compressor. Throughout this application the terms axial pump, axial pump/compressor or pump will refer to and include both an axial pump and an axial compressor.

DESCRIPTION OF THE PRIOR ART

Axial pumps for liquids or gases employ a plurality of cylinders and reciprocating pistons that are aligned parallel to and disposed around a central axis. The pistons reciprocate successively within the cylinders with their strokes overlapping in time to provide continuous pumping of the working fluid. The distance a piston travels within the cylinder, i.e., travel, controls the amount of working fluid taken in and expelled in one complete cycle of a piston. The greater the distance traveled, the greater the amount of fluid pumped in one cycle. The product of the distance a piston travels in one-half of the cycle, the area of the cylinder and the number of cylinders equals the displacement of the pump. One or more valves allow flow of the working fluid in to and out of each cylinder on the intake and output strokes, respectively.

One method and means of actuating the pistons in an axial pump is to provide a plate, typically a swash or wobble plate, which is tilted relative to the pump axis. The plate engages the pistons so as to actuate each piston successively as rotation takes place. Depending on the design of the axial pump, either the plate or the cylinders and pistons are rotated such that there is relative rotation between the plate and the cylinders.

In an axial pump with a wobble plate, the plate rotates while the cylinders are stationary. In this type of pump, travel is typically fixed. Because travel is fixed, output from each cylinder is also typically fixed. A wobble plate axial pump typically has at least two valves allowing flow of the working fluid, one for intake and the other for output.

In an axial pump with a swash plate, the plate does not rotate while the cylinders and pistons rotate around the axis of the pump. However, in this type of pump it is possible to change the angle of the tilt to the swash plate. As the tilt of the swash plate is changed the travel of the piston, and therefore the amount of fluid pumped with each stroke, is changed. A swash plate axial pump typically has a port plate in contact with the top of the cylinder barrel that allows separate intake and output of the working fluid.

The port plate typically has at least two kidney-shaped openings, one that is open to each cylinder in which the piston is being retracted from the cylinder during rotation of the cylinder barrel, i.e., the intake stroke, and the other that is open to each cylinder in which the piston is being pushed into the cylinder during rotation of the cylinder barrel, i.e., the output stroke. Each end of the intake opening is separated from each end of the output opening by a distance equal to the diameter of a cylinder. One such separation, or "blocked bridge," is at top-dead-center, or "TDC;" the other is at bottom-dead-center, or "BDC." At TDC, a piston has finished the output stroke and is beginning the intake stroke. At BDC, a piston has finished the intake stroke and is beginning the output stroke. At TDC of the swash plate, and any output greater than zero, the distance between the swash plate surface and the top of the cylinder is at its shortest. At BDC of the swash plate, and any output greater than zero, the distance between the swash plate surface and the top of the cylinder is at its longest.

In a swash plate axial pump, TDC for the port plate and the swash plate are typically the same and fixed, i.e., the swash plate and port plate are "on time". The output of the pump is controlled by changing the distance a piston travels during a cycle, i.e., by changing the tilt angle of the swash plate. If the swash plate is rotated about the axis, the dead-center positions for the swash plate and port plate are no longer the same, i.e., they are "off time". This means that at TDC of the port plate a piston is either continuing its input stroke or is in the middle of its output stroke, depending on the direction of rotation of the swash plate.

One example of a swash plate that has its angled driving surface tilted to adjust the flow rate is in U.S. Pat. No. 4,455,920 issued Jun. 26, 1984 to Shaw. This patent discloses a conventional axial pump with an adjustable angle swash plate. Another is U.S. Pat. No. 5,724,879 issued Mar. 10, 1998 to Hugelman. This patent discloses a mechanism to vary the flow rate by using a double wedge system that rotates the wedges with respect to each other to vary the flow rate by increasing or decreasing the travel of the pistons while not altering the TDC positions of the swash plate and port plate.

Typical adjustable swash plate designs for axial pumps generally make use of a tilt platform with a pin-ended bearing support along the tilt axis. An external mechanism is then used to rotate the pin-ended platform. This configuration requires the tilt platform and pin-ended bearing structures to support the full pump thrust loads. Under high pressures the pivoting assembly will flex between the bearings so that at short stroke and high pressures the degree of flexure may be of the same order of magnitude as the stroke itself. As a result, stroke adjustment becomes unstable. For these reasons high pressure hydraulic pumps are only adjustable over a limited range. Structural rigidity and dynamic performance are compromised with an accompanying increase in pump vibration, noise, and small stroke dynamic stability. Furthermore the flexing of the swash plate support contributes to the noise of a working pump. An unnecessarily large pump housing is required to accommodate this approach adding to pump cost and size while further exacerbating rigidity and noise problems. These large pump housings often dwarf the size of the actual working parts of the pump. The pumps continue increasing in size as the need for higher pressures continues putting increasing demands on the pumps.

In a conventional pivoting swash plate axial pump, reducing the stroke extracts the piston assembly from the cylinder barrel reducing the piston/cylinder contact length and increasing clearance volume. To correct for this reduced contact length, the pistons are lengthened to maintain sufficient contact length at the shortest stroke. As a result, the cylinders and pistons are longer than necessary which adds to pump size, weight and cost.

SUMMARY OF THE INVENTION

Applicant's axial pump is configured as a multi-piston pump with a rotating cylinder barrel where the pistons are actuated by a tilted swash plate. In this it is similar to and uses basic parts common to conventional pumps. However, applicant's pump differs in how the swash plate is supported and how variable output is achieved.

Applicant's axial pump uses a single solid wedge as a swash plate with the base of the wedge buttressed against the pump housing or case. The tilt angle of the wedge is fixed. Thus there is no pin-ended bearing support to flex. This design provides for a very compact design tightly wrapped around the internal working parts resulting in low noise and increased pressure capacity.

The output is controlled and varied by rotation of the wedge. The rotation puts the pump "off time" relative to the fixed port plate. This rotation changes the timing of the piston strokes with respect to TDC and BDC of the fixed port plate so that a portion of the intake charge is breathed back up stream through the intake port and a portion of the output charge is breathed back up stream through the output port. The net result is that pistons do not pull in a full charge nor pump out a full charge. The greater the degree of rotation of the wedge, the more of the charge in each cycle is breathed back into its respective port. At 90 degrees rotation of the wedge, one half of each cycle is breathed back. That is, the same amount of fluid is taken in and breathed back out on the input side of the pump. Likewise, the same amount of fluid is pushed out and breathed back in on the output side of the pump. The net result is zero fluid flow into and out of the pump. Thus rotation of the wedge varies the flow rate of the pump.

In one embodiment the wedge is a solid wedge maintained in one axial position with respect to the cylinder barrel so that the clearance volume remains constant. In a second embodiment the wedge, although still solid, is allowed to move axially so that the clearance volume can be varied. In this way, the compression ratio of a gas compressor can be varied independently of piston travel distance in the compressor.

OBJECTS AND ADVANTAGES

It is an object to provide an axial pump that is smaller in size yet delivers the same or higher pump capacity than previous designed axial pumps that used a pivoting swash plate to vary the flow rate.

It is another object to eliminate the pivoting swash plate of prior art axial pumps that was used to vary the flow rate and use a wedge that maintains the same tilt angle with respect to the pistons.

It is another object to eliminate the pin-ended large bearing supported swash plate of the prior art axial pumps and instead use a solid wedge that is supported by the pump case or housing. An advantage of using a solid wedge supported by the housing is that it results in a smaller size pump for the same volume of fluid flow.

It is still another object of this invention to provide an axial pump that provides a variable flow rate by means of breathing portions of the intake and output charges back into their respective ports resulting in a reduced charge delivered from the output. A related object is to vary the flow rate of a fluid from an axial pump by rotating the wedge to change the timing of the pistons with respect to the inlet and outlet ports, thus varying the amount of fluid drawn into the cylinder from the inlet port and the amount of fluid exhausted into the outlet port These and other objects and advantages will be apparent from the following Description of the Drawings and Description of the Preferred Embodiment.

DESCRIPTION OF THE PREFERRED EMBODIMENT

Figure 1:
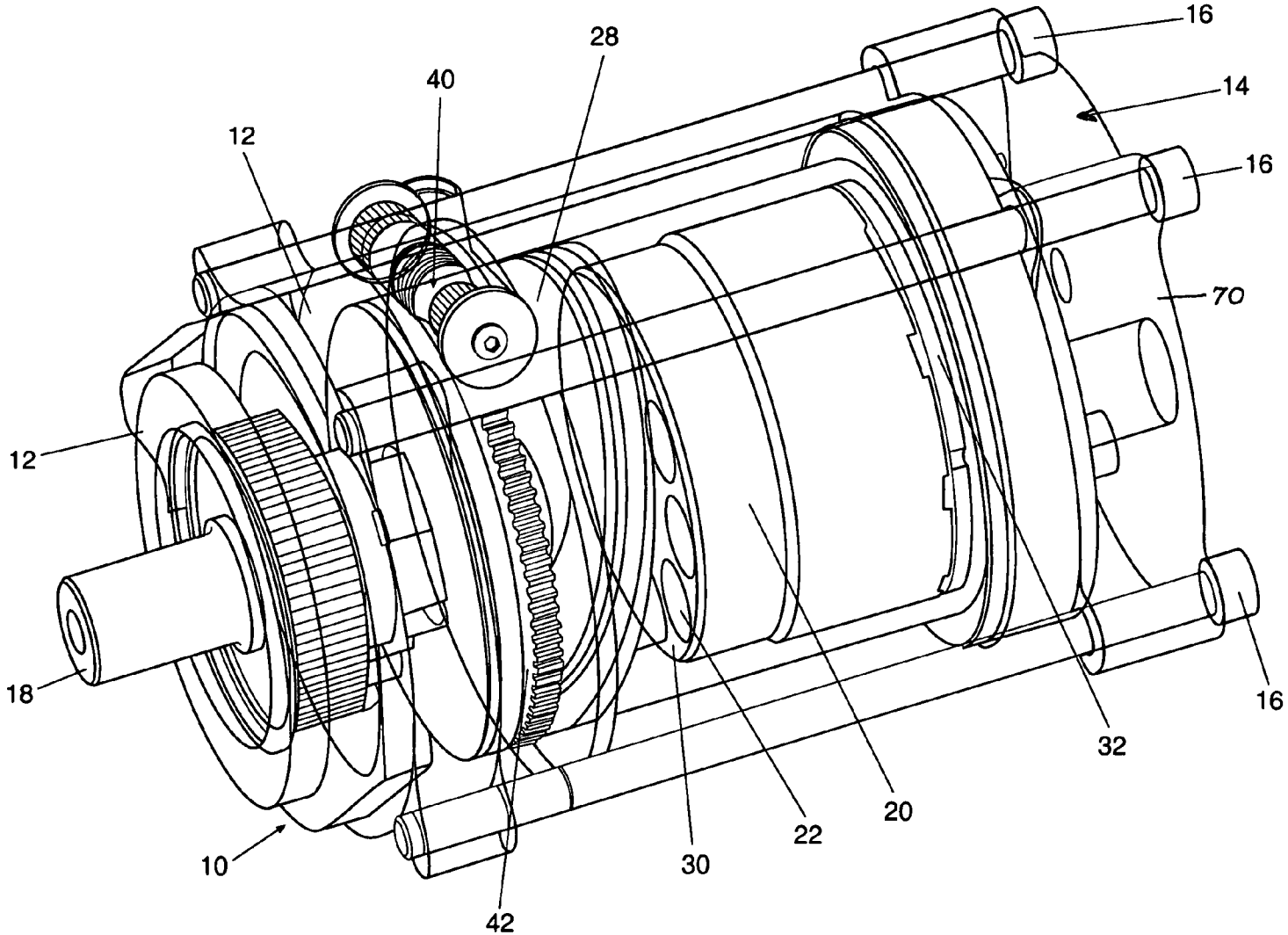
FIG. 1 is a perspective view with portions of the housing removed of the inventive pump.
Figure 2:
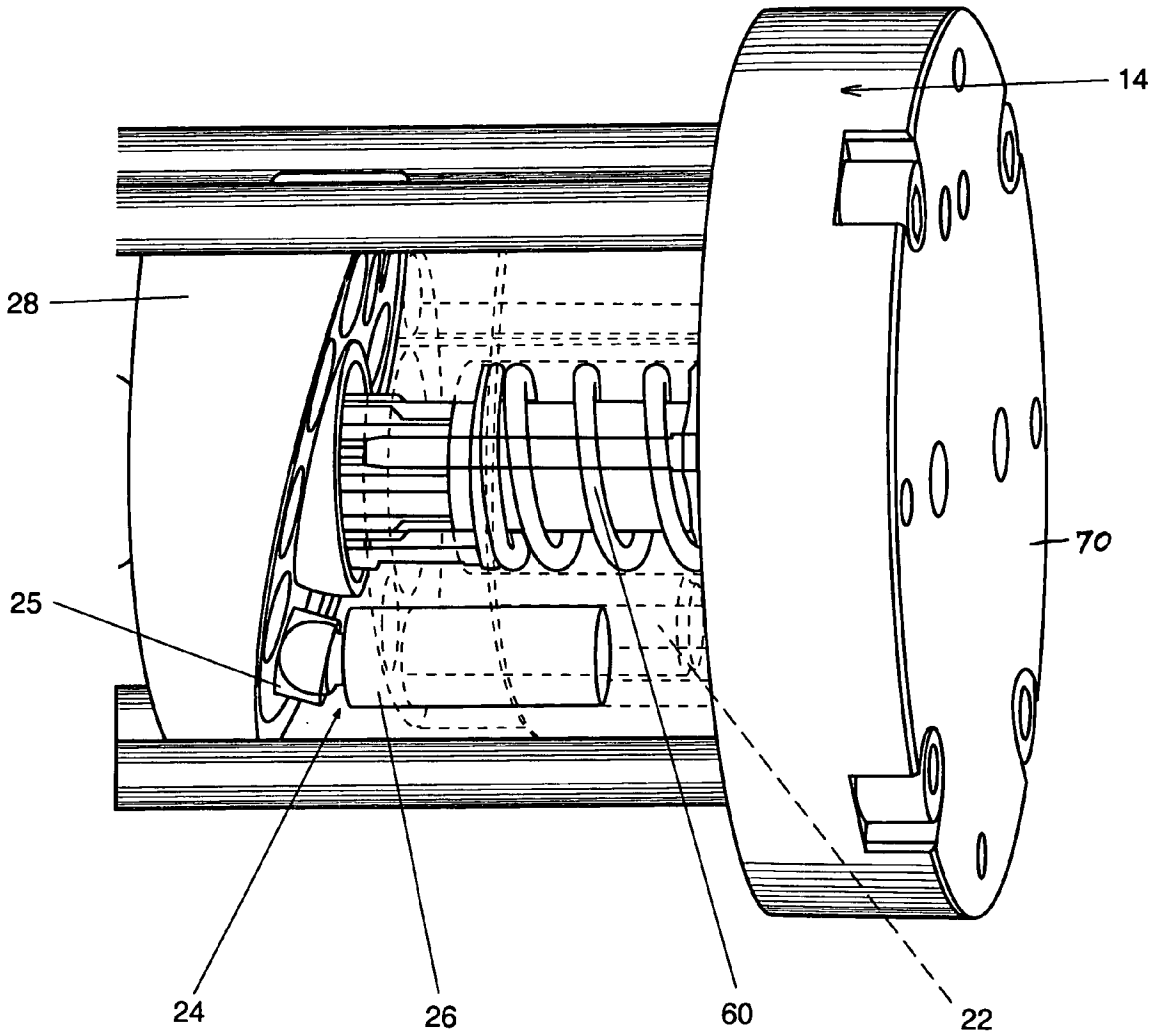
FIG. 2 is an enlarged perspective view with portions removed of the cylinder, piston and swash plate. For clarity, only one of the pistons is shown in a cylinder.
Figure 3:
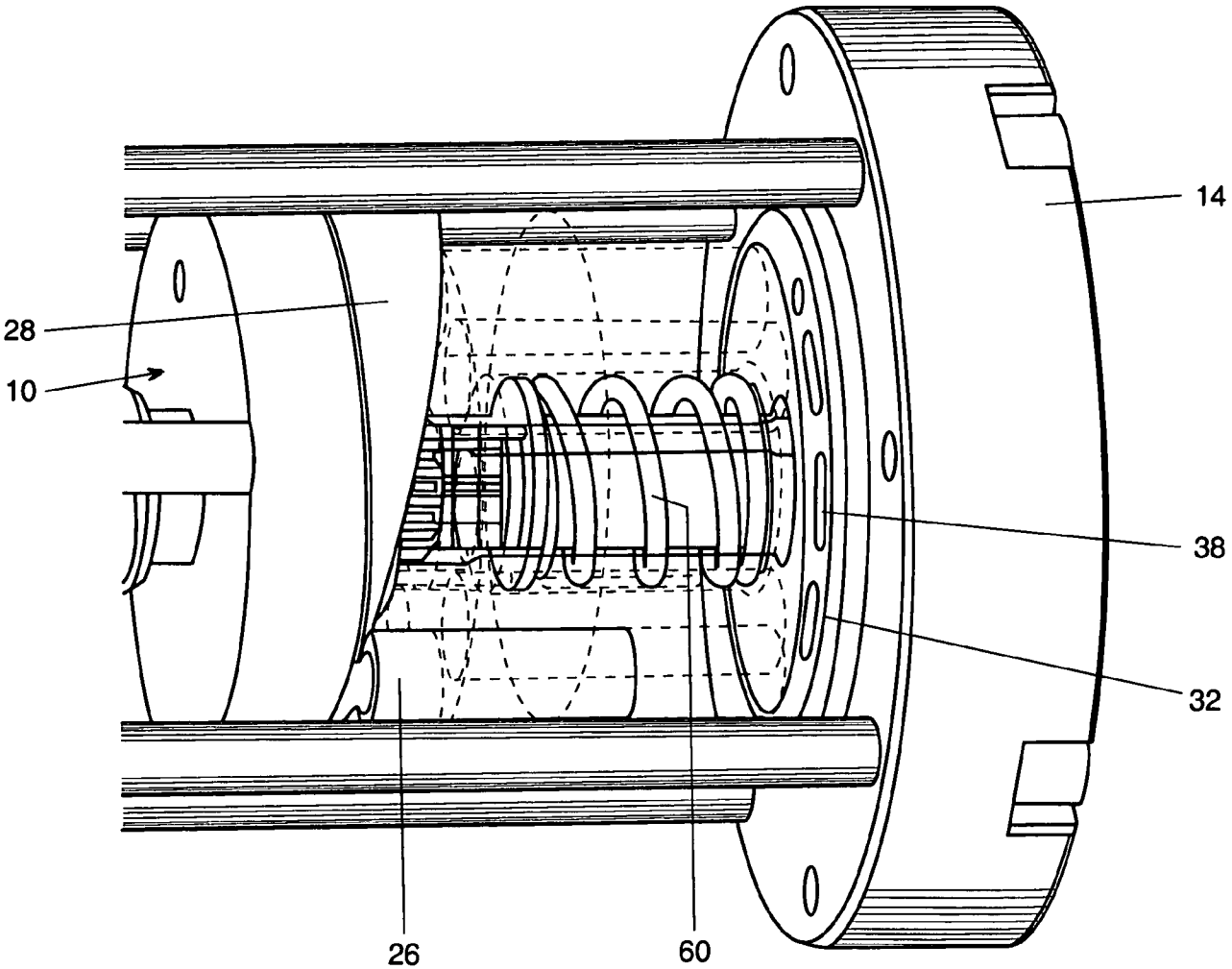
FIG. 3 is an enlarged perspective view of the intake and exhaust openings in the cylinder barrel.

Turning to FIGS. 1-2, there is illustrated an axial pump/compressor 10 of the present design. The pump 10 is contained within a front housing 12 attached to a main housing or case 14 by means of long case bolts 16. A drive shaft 18 spins a cylinder barrel 20 containing a plurality of cylinders 22. There is a piston assembly 24 having a piston foot 25 at one end and a piston 26 at the other end extending into each of the cylinders 22. The pistons 26 cycle as the cylinder barrel 20 is spun by the drive shaft 18. There is a wedge 28 near a foot end 30 of the cylinder barrel 20 that causes the pistons 26 to reciprocate as the cylinder barrel 20 is spun. The term "wedge" used throughout this application is meant to include a wobble plate, wedge swashplate and swashplate. Near a head end 32 of the cylinder barrel 20 is a fixed port plate 33 (FIG. 4) with fixed inlet ports 34 and fixed outlet ports 36 (FIG. 5). There are piston cylinder openings 38 (FIG. 3) in the head end 32 of the rotating cylinder barrel 20 that pass over the fixed inlet and outlet ports 34, 36. During operation of the pump, a low pressure charge is drawn in through the inlet port 34 and a high pressure charge is delivered at the outlet port 36. The port plate 33 and inlet and outlet ports 34, 36 are fixed in position relative to the front housing 12 and main housing 14 while the wedge 28 can be rotated around the axis of the drive shaft 18 or pump axis. A worm drive assembly 40 mounted on the front housing 12 drives a worm gear 42 that in turn rotates the wedge 28 about the axis of the drive shaft 18.

Figure 4:
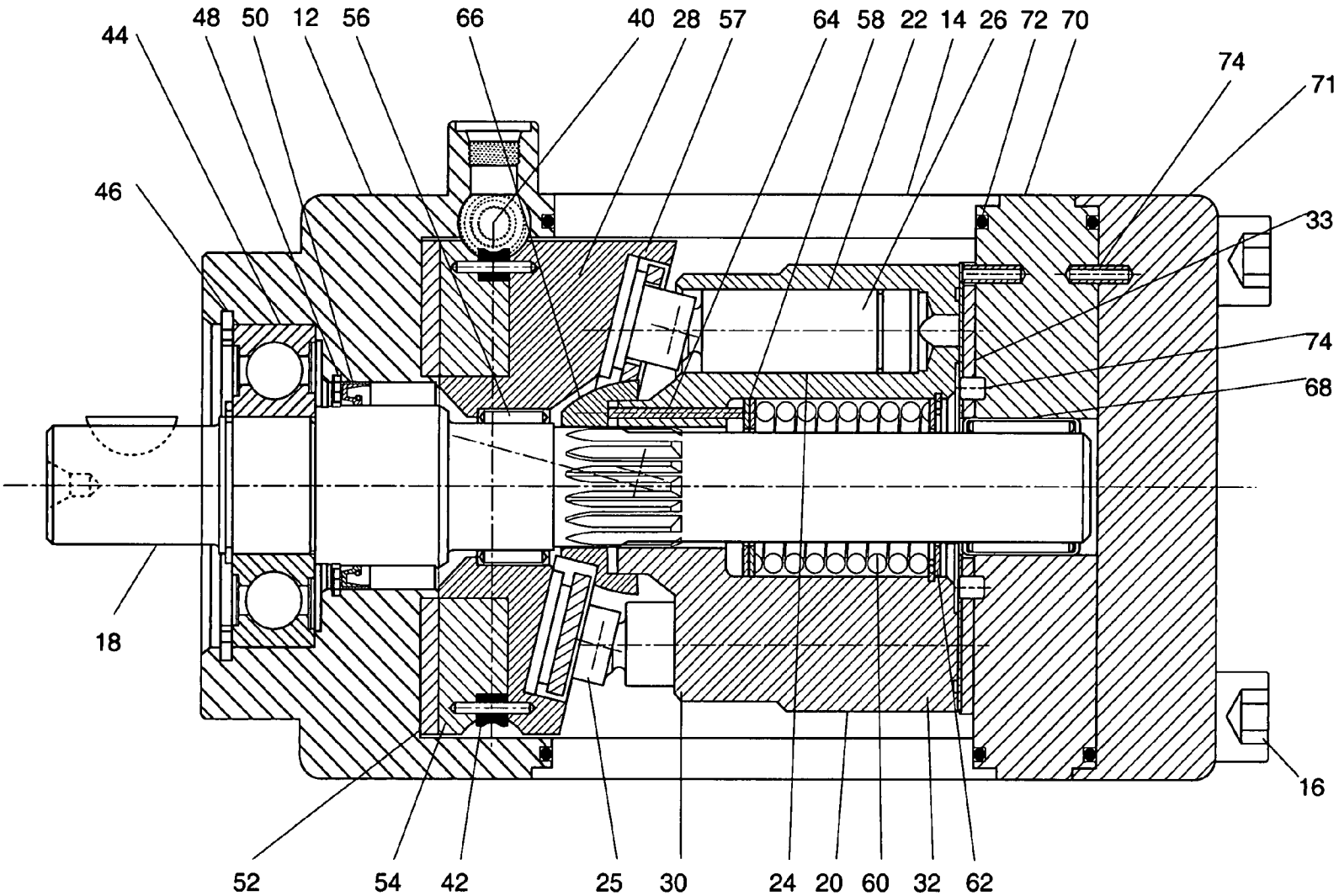
FIG. 4 is a cross sectional view with portions removed of the axial pump.
Figure 5:
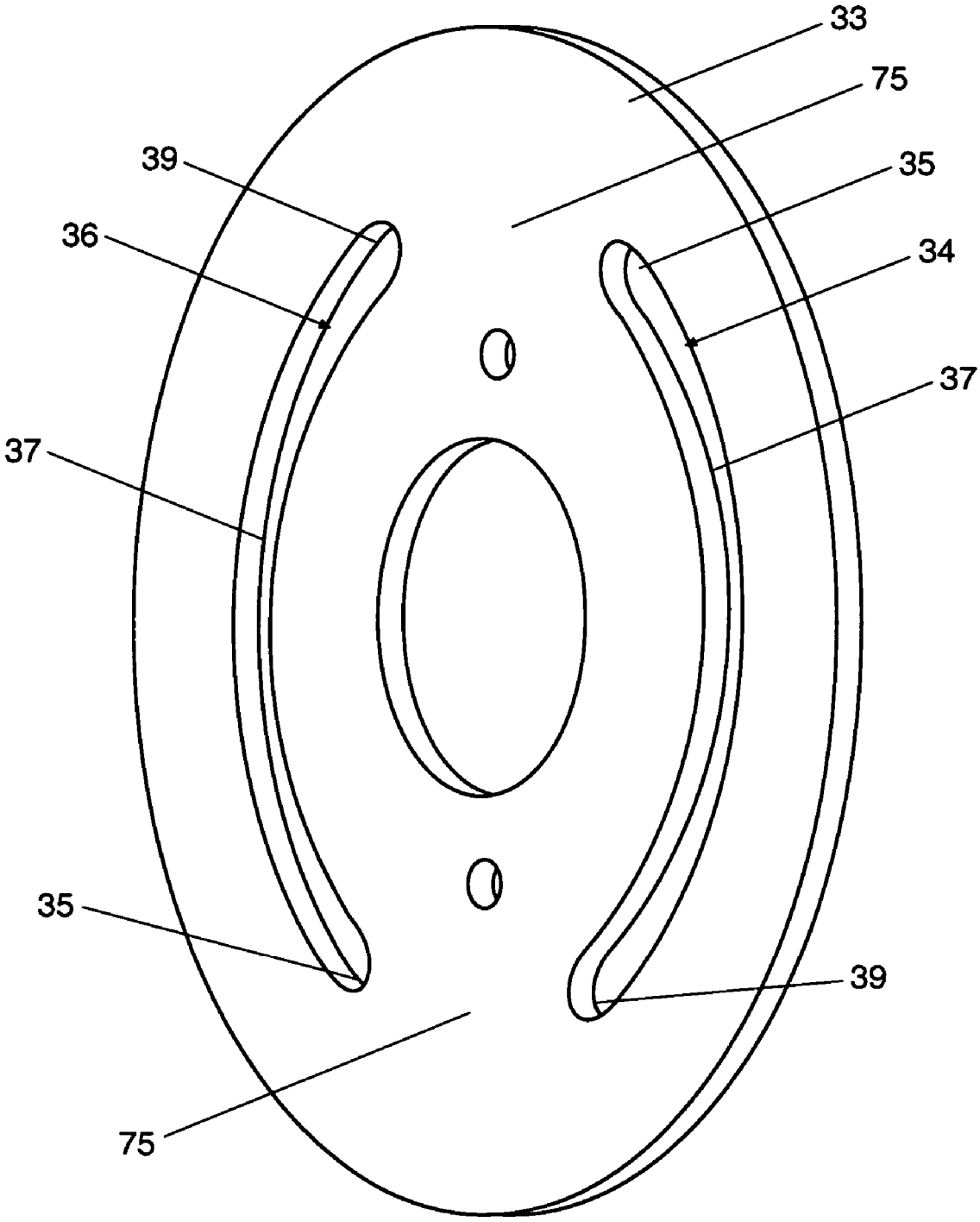
FIG. 5 is a perspective view of the port plate.

FIG. 4 illustrates in greater detail the components of the axial pump 10. The stationary components will be addressed first. There is a main bearing 44 press fitted into the front housing 12. The bearing 44 is secured with a snap ring 46 and a drive shaft seal 50 is secured with snap ring 48. A drive shaft oil seal 50 is press fitted into the housing 12 around the drive shaft 18. There is a Teflon® thrust bearing 52 fitted into the inner face of the front housing 12. The worm gear 42 is attached to a wedge thrust collar 54. A needle bearing 56 is press fitted in the wedge 28 around the drive shaft 18. The worm drive assembly 40 must drivingly engage the worm gear 42 so that when the worm drive assembly 40 is activated it rotates the worm gear 42 which in turn rotates the wedge 28. The wedge 28 may have a smooth slipper plate 57 installed on its angled face.

The rotating components will now be discussed also with reference to FIG. 4. Cylinder barrel spacers 58, spring 60 and snap ring 62 are all installed into the cylinder barrel 20. Dowel thrust pins 64 are installed into holes in the foot end 30 of the cylinder barrel 20. A ball seat 66 is mounted on the foot end of the cylinder barrel 20. One piston 26 is inserted into each cylinder 22 through the piston cylinder opening 38 in the foot end 30 of the cylinder barrel 20. In the preferred embodiment there are nine piston assemblies equally positioned around the cylinder barrel 20. The dowel thrust pins 64 compress the spring 60 holding the head end of the cylinder barrel and its cylinder face against the port plate 33. The piston foot 25 is held firmly against the slipper plate 57 which in turn is pressed against the wedge 28 and against the thrust bearing 52.

The drive shaft 18 is retained within needle bearings 68 in an inner end cap 70. There is an outer end cap 71 disposed at the rear of the pump 10 that is bolted to the case or main housing 14. The port plate 33, inner end cap 70, outer end cap 71 and main housing 14 are all properly positioned by O-rings 72 and lock pins 74. The case bolts 16 secure the front housing 12, main housing 14, inner end cap 70 and outer end cap 71, with all internal components securely fastened or positioned within.

The pistons 26 move through one intake and one exhaust stroke with one complete rotation of the of the cylinder barrel 20. The pistons 26 move out of cylinders 22 from a top dead center point to a bottom dead center point and into cylinders 22 from a bottom dead center point to a top dead center point. Unlike prior devices the flow control is not controlled by adjusting the angle of a swashplate which in turn varies the distance a piston travels.

Rather, the flow rate in Applicant's invention is controlled by rotation of the wedge 28. Rotating the wedge 28 by means of the worm drive assembly 40 and worm gear 42 changes the timing, or travel, of the pistons 26 with respect to the fixed port plate 33 and the inlet and outlet ports 34, 36. As seen in FIG. 5, the inlet port 34 and the outlet port 36 are elongated slots each having a beginning portion 35, a middle portion 37 and an end portion 39. As will be more fully described below portions of the intake and output charges are breathed back through the inlet port 34 and outlet port 36, respectively. The rotation of the wedge 28 puts the pump "off time" relative to the fixed port plate 33. The pistons 26 do not pump out a full charge from bottom dead center ("BDC") to top dead center ("TDC") nor pull in a full charge from TDC to BDC. Rather, since the pistons are now "off time" with respect to the fixed port plate 33, a portion of the intake charge taken in through the inlet port 34 will be breathed, or discharged, back out through the inlet port 34. Likewise, a portion of the output charge pumped out through the outlet port 36 will be breathed back in through the outlet port 36. The net result is that less fluid is taken into, and discharged from the pump. Thus the degree of rotation of the wedge 28 determines the cycled breathing volume and varies the flow rate of the pump.

Figure 6:
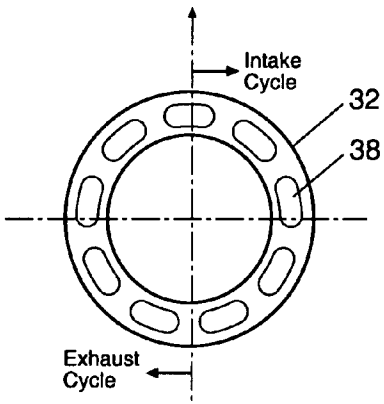
FIG. 6 is a top schematic view of the orientation of the rotating cylinders during the intake and exhaust cycles.
Figure 7:
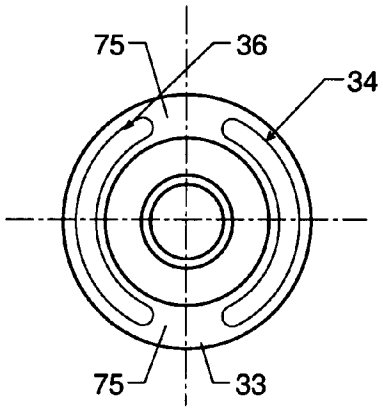
FIG. 7 is a top schematic view of the orientation of the port plate and the inlet and outlet ports.
Figure 8A:
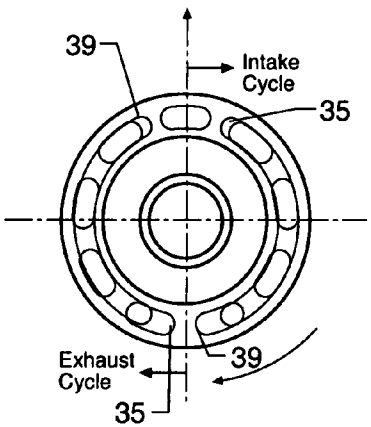
FIGS. 8*a*-8*d* are schematic views of the orientation of the rotating cylinders to the port plate during rotation of the wedge from 0° to 90°.

FIG. 6 illustrates the orientation of the nine piston cylinder openings 38 in the head end of the cylinder barrel 32. The cylinder barrel rotates one-half revolution (180°) during the intake cycle and one-half revolution (180°) during the output, or "exhaust" cycle. FIG. 7 illustrates the orientation of the fixed port plate 33 and the inlet and outlet ports 34, 36. There is a bridge 75 between the inlet and outlet ports 34, 36. The bridge 75 causes a volume of trapped fluid as the piston cylinder opening 38 rotates and passes over the blocked bridge 75. With the wedge 28 at 0°, the cylinders are oriented as seen in FIG. 8*a*. The cylinders are superimposed over the port plate 33. This illustrates optimum timing and 100% or full fluid flow with the piston 26 drawing in fluid from the beginning of the inlet port 35 to the end of the inlet port 39. During the cylinder's half rotation representing the intake cycle, the cylinder is positioned over the inlet port 34 for the full intake cycle or movement from TDC to BDC and draws in a full charge. The piston cylinder opening is likewise positioned over the outlet port 36 from the beginning of the slot 35 to the end of the slot 39 representing the movement of the piston 26 during the exhaust cycle from BDC to TDC and discharges a full charge.

Figure 8B:
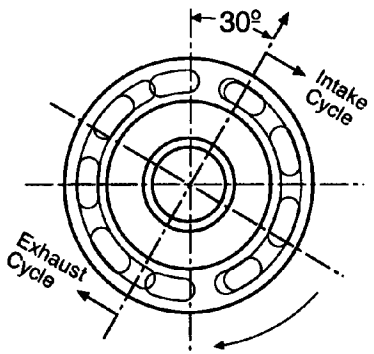
Figure 8C:
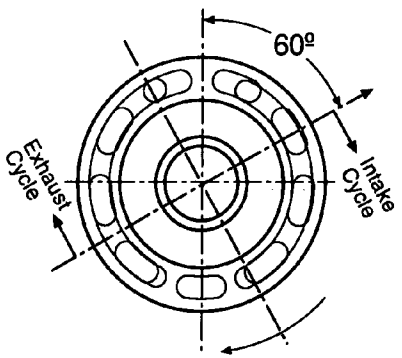

FIG. 8*b* illustrates the wedge 28 rotated 30° from top dead center. TDC and BDC of the piston intake and exhaust cycles are shifted 30° while the beginnings and ends of the inlet and outlet ports 34, 36 have remained stationary. This causes the piston to delay its ending of the exhaust cycle and beginning of the intake cycle by 30°. The result is that part of the exhaust cycle is breathed back into the inlet port 34 and the start of the intake stroke is delayed causing less fluid to be drawn in from the inlet port 34. Likewise, part of the intake cycle is breathed back into the cylinder through the outlet port 36 and the start of the exhaust cycle is delayed causing less fluid to be pumped out of the outlet port 36. This "off timing" wedge position results in decreased fluid flow from the outlet of the pump. FIG. 8*c* illustrates the wedge 28 rotated 60°. TDC and BDC of the intake and exhaust cycles are shifted 60°. This causes the piston to delay its ending of the exhaust cycle and the beginning of the intake cycle by 60°. The result is that compared to the 30° shift in the cycle as illustrated in FIG. 8*b*, more of the exhaust cycle is breathed back into the inlet port 34 and there is less fluid drawn through the inlet port 34 into the cylinder during the intake cycle. Also, more fluid is breathed back into the cylinders from the outlet port 36 during the exhaust cycle. This increased "off time" wedge position results in substantially decreased fluid flow to the outlet port.

Figure 8D:
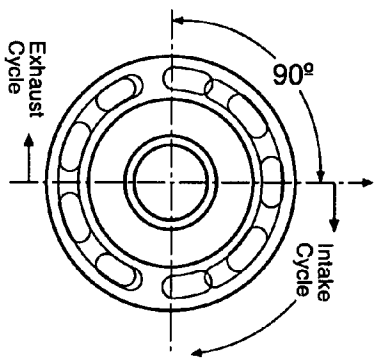

FIG. 8*d* illustrates the wedge rotated 90°. Here fully half of the exhaust cycle is breathed back into the inlet port 34 and half of the intake cycle is breathed back from the outlet port 36. The net result is that there is no fluid flow to the pump's outlet even though the cylinder barrel 20 is still rotating at the same speed as it was during full fluid flow.

Although the preferred embodiment describes the invention as using a rotatable wedge to vary and control the timing to thereby control the fluid, the invention can also be used when the wedge remains stationary and the port plate and a portion of the end cap are rotated as a unit with respect to the wedge. This results in varying the timing as described in the preferred embodiment. The invention can also be used in a pump/compressor where the cylinder barrel is held stationary and the wedge is spun and a portion of the end cap is rotated as a unit with respect to TDC and BDC of the cylinder barrel.

Figure 9:
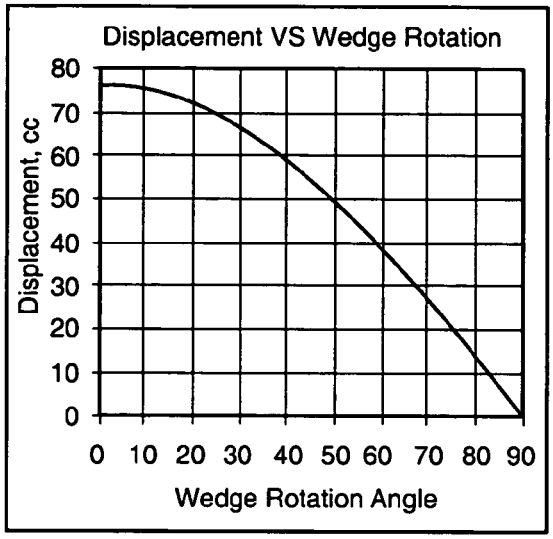
FIG. 9 is a graph of the displacement curve of the inventive pump as the wedge is rotated from 0° to 90°.

The output flow rate as a function of wedge rotation is illustrated in FIG. 9. The flow rate starts at its maximum flow rate at 0° wedge rotation and is reduced to zero flow rate at 90° wedge rotation.

Figure 10:
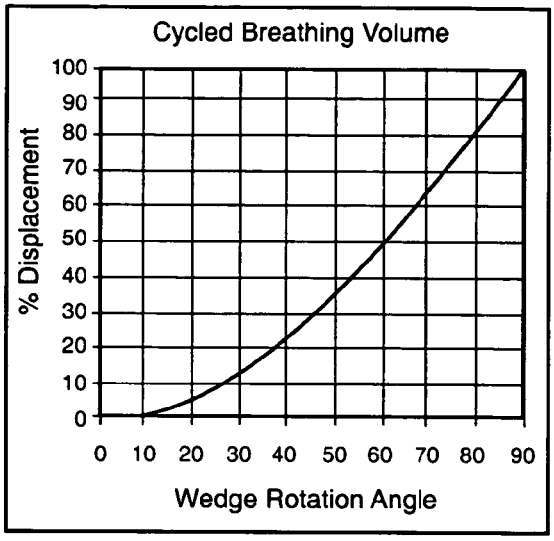
FIG. 10 is a graph of Cycled Breathing Volume which shows the volume percentage that is breathed back into a port as a function of wedge rotation.

FIG. 10 is a graph of Cycled Breathing Volume. This is actually the inverse of the graph of FIG. 9 but shows the volume percentage which is breathed back into and out of the pump as the wedge rotation angle is increased from 0° to 90°.

Figure 11:
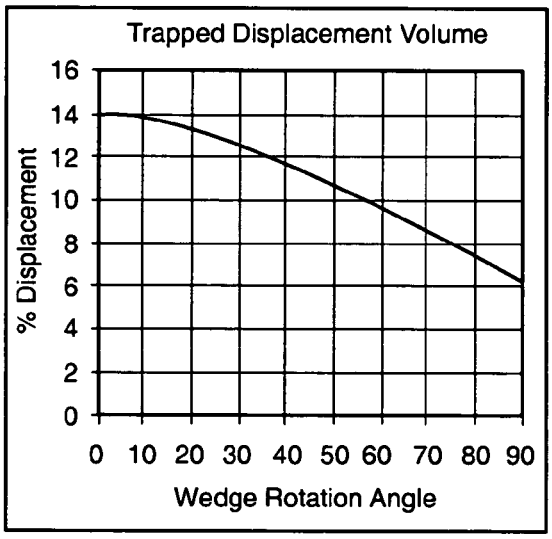
FIG. 11 is a graph of Trapped Displacement Volume which shows the volume percentage "trapped" as the piston port rotates across the blocked bridge between the inlet and outlet ports.

FIG. 11 is the Trapped Displacement Volume. This shows the volume percentage "trapped" as the piston cylinder opening 38 rotates and passes across the blocked bridge 75 between the inlet and outlet port 34, 36 of the port plate 33. This is important as during the transition period the piston contents are trapped with nowhere to go. The result is hydraulic lock for a hydraulic pump, but there is no effect upon a gas compressor. To prevent hydraulic lock damage, relief grooves must be cut along the track to allow the fluid trapped over the bridge to bleed back. The question arose as to whether the "off time" breathing would exacerbate the hydraulic locking problem common to all axial hydraulic pumps but as FIG. 11 illustrates, the percentage of trapped displacement actually decreases with wedge rotation and breathing.

As described, the wedge 28 is rotated by means of the worm drive assembly 40. However, this can be replaced with a hydraulic or pneumatic cylinder with a piston operatively connected to the wedge 28 for rotation of the wedge 28.

Figure 12:
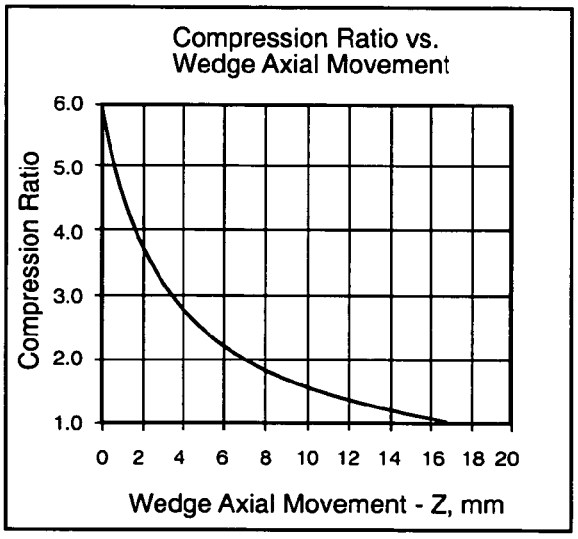
FIG. 12 is a graph of the compression ratio verses wedge axial movement.

In the inventive pump 10 the compression ratio is physically fixed since there is no change in wedge angle of axial position. However, in an alternate embodiment, the compression ratio can be changed by moving the wedge 28 and its driven piston assembly 24 axially. A plot of "Compression Ratio vs. Wedge Axial Movement" is seen in FIG. 12 for this added feature. One method of adjusting the compression ration is illustrated in U.S. Pat. No. 6,629,488 incorporated herein by reference.

Thus there has been provided an axial pump/compressor that fully satisfies the objects set forth above. While the invention has been described in conjunction with a specific embodiment, it is evident that many alternatives, modifications and variations will be apparent to those skilled in the art in light of the foregoing description. Accordingly, it is intended to embrace all such alternatives, modifications and variations as fall within the spirit and scope of the appended claims.

What is claimed:

1. An axial pump/compressor comprising:

a pump housing, a drive shaft mounted within the pump housing, a first drive shaft bearing mounted at a drive shaft entrance end of the pump housing and a second drive shaft bearing at a distal end of the pump housing, the drive shaft supported by the first and second drive shaft bearings, a cylinder barrel having opposite ends and having a plurality of cylinders disposed therein, a piston slidably disposed within each cylinder for reciprocating movement defining an intake and output stroke, a port plate having inlet and outlet ports thereon, the inlet and outlet ports having a length with a beginning and an end mounted adjacent to one end of the cylinder barrel for providing fluid into and out of the cylinders, a wedge member mounted at the opposite end of the cylinder barrel between the first drive shaft bearing and the second drive shaft bearing and having an angled surface facing the pistons, the wedge member mounted in driving relationship with the pistons, with the drive shaft passing through the wedge member, the drive shaft providing rotative power to cause relative rotation between the cylinder barrel and the wedge member for reciprocating the pistons between top dead center and bottom dead center positions, the pistons drawing fluid into the cylinder through the inlet port during an intake stroke and discharging fluid through the outlet port during an output stroke, means for varying the quantity of fluid discharged by the pump/compressor comprising means for rotating the wedge member for adjusting the time of the beginning and end of the intake stroke with respect to the intake port so that the pistons begin to draw fluid from the inlet port at a location along the inlet port removed from the beginning of the inlet port, and for adjusting the time of the beginning and end of the output stroke so that the pistons begin to discharge fluid into the outlet port at a location along the outlet port removed from the beginning of the outlet port to adjust the quantity of fluid drawn in during the intake stroke and the amount of fluid discharged during the output stroke with the pistons maintaining a constant volumetric displacement during the intake strokes and output strokes regardless of the rotation of the wedge member.

2. The pump/compressor of claim 1 wherein the means for adjusting the time of the beginning and end of the intake and output strokes varies the timing so that a portion of the fluid that is discharged during the output stroke is discharged into the inlet port.

3. The pump/compressor of claim 1 wherein the means for adjusting the time of the beginning and end of the intake and output strokes varies the timing so that a portion of the fluid drawn into the cylinder during the intake stroke is drawn from the outlet port.

4. The compressor/pump of claim 1 wherein the wedge member has a circumference surrounding the wedge member and gear means mounted on the circumference and a pinion drivingly engaging the gear means.

5. The compressor/pump of claim 1 wherein the means for rotating the wedge member comprises a cylinder and piston engaging and rotating the wedge member.

6. An axial compressor/pump comprising:

a pump housing;

a drive shaft mounted within the pump housing, the drive shaft having a central axis, a first drive shaft bearing mounted at a drive shaft entrance end of the pump housing and a second drive shaft bearing at a distal end of the pump housing, the drive shaft supported by the first and second drive shaft bearings, a cylinder barrel having a plurality of cylinders, a piston disposed within each of the cylinders, the pistons reciprocating between a top dead center position and a bottom dead center position, the movement from the bottom dead center position to the top dead center position defining the output stroke and the movement from the top dead center position to the bottom dead center position defining the intake stroke, a wedge member mounted in the pump housing between the first drive shaft hearing and the second drive shaft bearing with the drive shaft passing through the wedge member and having an angled driving surface facing the pistons, the wedge member mounted with the angled driving surface in driving relationship with the pistons for causing the pistons to reciprocate when the cylinder barrel is rotated with respect to the wedge member, the angled driving surface of the wedge member determining the position of the pistons as the cylinder barrel is rotated with respect to the wedge member, the angled driving surface maintaining a constant angle with respect to the central axis of the drive shaft, a fluid inlet port for supplying fluid to the cylinder at a first pressure during the intake stroke, the fluid inlet port being an elongated slot with a beginning, middle and end portion, a fluid outlet port for discharging the fluid from the cylinder at a second pressure during the output stroke, the fluid outlet port being at least one elongated slot with a beginning, middle and end portion, means for varying the quantity of fluid discharged by the pump/compressor comprising means for rotating the wedge member for controlling the position of the piston with respect to the beginning of the fluid inlet and beginning of the fluid outlet ports as the piston begins the intake stroke and the output stroke, the rotation of the wedge member causing the beginning of the intake stroke to vary thereby causing the piston to receive a varying amount of fluid depending on the location of the piston at the beginning of the intake stroke with respect to the fluid inlet port, the rotation of the wedge member further causing the beginning of the exhaust stroke to vary thereby causing the piston to discharge into the fluid outlet port a variable amount of the fluid depending on the location of the piston at the beginning of the output stroke with respect to the fluid outlet port with the pistons maintaining a constant volumetric displacement during the intake strokes and output strokes regardless of the rotation of the wedge member.

7. The axial compressor/pump of claim 6 wherein when the wedge member is rotatable between zero and ninety degrees for adjusting the beginning of the intake stroke and the beginning of the output stroke and wherein zero degrees is the optimum performance position with the cylinder drawing in a full charge and pumping out a full charge.

8. The axial compressor/pump of claim 7 wherein when the wedge member is at zero degrees the intake stroke begins as the piston is disposed over the beginning of the fluid inlet port.

9. The axial compressor/pump of claim 7 wherein when the wedge member is at ninety degrees the intake stroke begins as the piston is disposed over the middle of the fluid inlet port.

10. The axial compressor/pump of claim 7 wherein when the wedge member is at zero degrees the output stroke begins as the piston is disposed over the beginning of the fluid outlet port.

11. The axial compressor/pump of claim 7 wherein when the wedge member is at ninety degrees the output stroke begins as the piston is disposed over the middle of the fluid outlet port.

12. The axial compressor/pump of claim 7 wherein as the wedge member rotates between zero and ninety degrees, an increasing portion of the fluid discharged from the output stroke is discharged into the fluid inlet port, until at ninety degrees, an equal amount of fluid is discharged from the output stroke into the fluid inlet port as the amount of fluid drawn into the cylinder from the fluid inlet port during the intake stroke.

13. The axial compressor/pump of claim 7 wherein as the wedge member rotates between zero and ninety degrees, a decreasing portion of the fluid is drawn into the cylinder from the fluid inlet port and an increasing portion is drawn in from the fluid outlet port, until at ninety degrees, an equal amount of fluid is drawn in from the fluid inlet and fluid outlet ports.

14. The compressor/pump of claim 6 wherein the means for rotating the wedge member comprises gear means engaging the wedge member.

15. The compressor/pump of claim 14 wherein the wedge member has a circumference surrounding the wedge member and the gear means comprises a gear mounted on the circumference and a pinion drivingly engaging the gear.

16. A method for controlling the fluid flow from an axial compressor/pump comprising the steps of:

providing a pump housing, providing a drive shaft mounted within the pump housing, the drive shaft having a central long axis, mounting a first drive shaft bearing at a drive shaft entrance end of the pump housing and a second drive shaft bearing at a distal end of the pump housing, supporting the drive shaft with the first and second drive shaft bearings, providing a cylinder barrel with a plurality of pistons therein, providing a wedge member mounted in the pump housing and having an angled driving surface facing the pistons, the wedge member mounted between the first drive shaft bearing and the second drive shaft bearing with the drive shaft passing through the wedge member with the angled driving surface in driving relationship with the pistons, rotating the cylinder barrel with respect to the wedge member for causing the pistons to reciprocate defining an intake stroke and an output stroke, supplying fluid to the cylinder through a fluid inlet port at a first pressure during the intake stroke, the fluid inlet port being an elongated slot with a beginning, middle and end portion, discharging the fluid from the cylinder through a fluid outlet port at a second pressure during the output stroke, the fluid outlet port being at least one elongated slot with a beginning, middle and end portion, rotating the wedge member for controlling the position of the piston with respect to the inlet and outlet ports as the piston begins the intake stroke and the outlet stroke, varying the beginning of the intake stroke by rotating the wedge member so that the piston begins to draw fluid from the inlet port at a location along the inlet port removed from the beginning of the inlet port, a portion of the fluid drawn into the cylinder during the intake stroke having a portion of the fluid drawn in from both the fluid inlet port and from the fluid outlet port thereby causing the piston to receive a varying amount of fluid depending on the location of the piston at the beginning of the intake stroke with respect to the fluid inlet port, varying the beginning of the output stroke causing the piston to discharge into the fluid outlet port a varying amount of the fluid depending on the orientation of the beginning of the output stroke to the fluid outlet port, maintaining a constant volumetric displacement during the intake strokes and output strokes regardless of the rotation of the wedge member.

17. The method of claim 16 and further comprising the step of varying the beginning of the output stroke by rotating the wedge member so that the piston begins to discharge fluid into the outlet port at a location along the outlet port removed from the beginning of the outlet port, a portion of the fluid pumped from the cylinder has a portion of the fluid pumped back into the fluid outlet port and a portion of the fluid pumped into the fluid inlet port thereby controlling the fluid flow from the axial compressor/pump.

18. The method of claim 16 and further comprising the step of varying the beginning of the intake stroke by rotating the wedge member so that a portion of the fluid drawn into the cylinder during the intake stroke is breathed back into the fluid inlet port thereby controlling the fluid flow from the axial compressor/pump.

19. The method of claim 16 and further maintaining the angled driving surface of the wedge member at a constant angle with respect to the central long axis of the drive shaft regardless of the rotation of the wedge member.

* * * * *